United States Patent [19]

Hild et al.

[11] 4,449,467

[45] May 22, 1984

[54] VARIABLE WEIGHT CLOTH ROLLER-FURLING SAIL

[75] Inventors: Herbert A. Hild, Rye; Walter Scanlon, Bronx, both of N.Y.

[73] Assignee: Hild Sails, Inc., Bronx, N.Y.

[21] Appl. No.: 392,680

[22] Filed: Jun. 28, 1982

[51] Int. Cl.[3] ..... B63H 9/04

[52] U.S. Cl. ..... 114/103; 114/107

[58] Field of Search ..... 114/102–107, 114/39

[56] References Cited

U.S. PATENT DOCUMENTS

| | | | |
|---|---|---|---|
| 2,197,654 | 4/1940 | Beaudry | 114/107 |
| 3,285,215 | 11/1966 | Potter | 114/106 |
| 3,602,180 | 8/1971 | Holmes | 114/106 |
| 4,196,687 | 4/1980 | Newick | 114/106 |

FOREIGN PATENT DOCUMENTS 11234 of 1903 United Kingdom .

*Primary Examiner*—Trygve M. Blix
*Assistant Examiner*—Jesus D. Sotelo
*Attorney, Agent, or Firm*—James J. McKeever

[57] ABSTRACT

A Roller-furling sail both main sail and head sail, such as jibs or genoas, are constructed in the reverse miter cut or Scotch cut. The sails are constructed of sail cloth panels to the luff with one mitered seam bisecting the angle made by the panels that run parallel to the foot and the leech of the sail. The panels running adjacent to the foot and the leech are of a heavier weight cloth than the remaining body of the sail. As the sail is furled a greater portion of the lighter weight sail cloth is taken up thereby leaving an increased percentage of the heavier sail cloth exposed to the stronger winds. The sail may also be provided with a luff flattening panel that is seared to the luff of the sail in a generally curved shape from the area of the tack to the area of the head of the sail. The luff flattening panel allows the sail to be partially furled and maintain the desired flat shape.

6 Claims, 4 Drawing Figures

VARIABLE WEIGHT CLOTH ROLLER-FURLING SAIL

BACKGROUND OF THE INVENTION

This invention relates generally to a new roller-furling sail construction and to a method of using said sail on sailing vessels.

More particularly this invention relates to a roller furling sail with at least two different weight sail cloths in its construction and which when furled retains its desired flat shape and to the method of using such sails on various sailing vessels.

DESCRIPTION OF THE PRIOR ART

Sails have been powering vessels ever since the early days of ancient Egypt. Sails have been made of various types of construction. There have been mitered cuts, scotch-cuts commonly known in the art as reverse miter cut, vertical cuts, horizontal cuts as well as others. It has been a relatively recent development to have the main and the head sail furl on sail boats. This is done mostly to achieve a measure of safety in heavy weather sailing with a minimum of sail handling. Various United States Patents have been issued on roller-furling systems for sail boats.

These roller-furling Patents that are known are:

- U.S. Pat. No. 3,938,460 issued Feb. 17, 1976 to Wales, et al, entitled, Sail-Raising System.
- U.S. Pat. No. 3,958,523 issued May 25, 1976 to T. S. Holmes, entitled, Sail Hoisting, Supporting and Furling operating.
- U.S. Pat. No. 3,980,036 issued Sept. 14, 1976 to D. H. Crall, entitled, Roller Furling Assembly.
- U.S. Pat. No. 4,034,694 issued July 12, 1977 to N. B. Dismuker, entitled Jib Furler.
- U.S. Pat. No. 4,080,917 issued Mar. 28, 1978 to Alter, et al, entitled Roller Furling Mechanism.
- U.S. Pat. No. 4,196,687 issued Mar. 5, 1978 to R. C. Newick, entitled Roller Furling Sail.
- U.S. Pat. No. 4,248,281 issued May 20, 1980 to F. E. Hood, entitled Sail Furling.
- U.S. Pat. No. 4,267,791 issued May 19, 1981 to J. P. Ingoref, entitled Jib Roller System.
- U.S. Pat. No. 4,267,790 issued May 19, 1981 to R. S. Hood, entitled, Sail Furling and Reefing opportunities.

While all of the above U.S. Patents constitute the body of art existing in the field of Roller-Furling none of them disclose or even suggest the roller-furling sail construction of the present invention.

Additional prior art related to but in no way anticapitory of the present invention are a number of patents that relate to the so-called scotch-cut jibs ranging from the Dec. 26, 1899 U.S. Pat. No. 639,916 entitled Sailing Vessel and including, U.S. Pat. No. 3,194,202 to P. K. Saunders July 13, 1965, U.S. Pat. No. 3,602,180 issued Aug. 31, 1971 to T. S. Holmes, and U.S. Pat. No. 3,828,711 issued Aug. 13, 1974 to Russel.

Even though these Patents show Scotch-cut jibs are old, none describe a scotch-cut roller-furling sail constructed with at least two different weight sail cloths.

U.S. Pat. No. 4,196,687 issued Mar. 5, 1978 to R. C. Newich entitled Roller-Furling Sail, describes a roller-furling jib that is designed to eliminate fullness. This patent does not anticipate the specific embodiment of the present invention which maintains the desirable flat sail shape when a roller-furling sail is partially furled.

SUMMARY OF THE INVENTION

The present invention relates to a roller furling sail construction that utilizes at least two different sail cloth weights, said sail being constructed so that as the sail is furled, it is predominently the lightest weight cloth that is the first cloth to be taken up leaving a greater percentage of the heavier weight cloth or cloths exposed to take the load of the heavier weather. At the same time the total sail area of the sail is reduced.

The present invention also envisions the additions to the roller-furling sail, a luff flattening panel which may be sewn, glued, taped or secured in any suitable manner to the luff of the sail, thereby taking up the draft of the sail as the sail is furled so the most desirable flat sail shape is not effected by reducing sail area in the process roller-furling.

Thus it is the object of the present invention to provide a single roller-furling sail that is effective in winds from up to 10 knots to over 40 knots.

Another object of the present invention is to provide a method of sail handling in varying wind conditions and eliminating the danger of sail changing in rough weather.

A further object of the present invention is to provide a roller-furling sail where the sail remains flat while reducing sail area.

These and other objects of the present invention will become evident by reading the following specification in connection with the accompanying drawings.

DETAILED DESCRIPTION OF THE INVENTION

Sailing has been part of the worlds transportation and sports for as long as recorded history. It has always been a problem for sailors to deal with varying wind conditions. There are various ways of dealing with this problem. The two principle ways of handling heavy air are reducing sail area and/or presenting a sail, usually a smaller sail, made of heavier sail cloth to the heavier air. At first, only reducing sail area was used and generally done only on main sails by what is known in the art as reefing. Reefing is accomplished by pulling the main sail down, to a predetermined point and tying it to the boom, whereas; furling is accomplished by rolling a sail up on itself in the manner of a window shade, but in a more vertical position.

In the early days, the only way to reduce sail area of the jib was to go forward to the fore deck and take down the working and genoa jib and put up a smaller, heavier head sail, such as a storm jib. In the mid part of this century roller-furling was introduced. Roller-furling is described in the United States Patents cited supra. While roller-furling reduces sail area, it has been still necessary to go forward to the fore deck put up a small heavy weight storm jib because the roller-furling said, while being able to be reduced in sail area, is made of a sail cloth weight that is too light for the heavy weather.

Safety as sea is always a major consideration. The most hazardous work on board a sail boat is done on the foredeck. As the wind increases white caps start to form and the deck begins to pitch just as it is necessary to venture forward to change to a small heavy storm jib. This situation represents a real danger.

The sail construction of the present invention eliminated this problem by allowing a sailor to reduce sail area from the cockpit and at the same time present, to the increasing wind a much increased percentage area of heavier sail cloth. In addition, this is accomplished without the usual problem of bulging draft, generally inherent in roller-furling sails, just when you need it least, that is, in heavy weather wind.

In the present invention, the sail is constructed in the reverse miter cut or as commonly known in the art as the Scotch-cut. This cut can be generally discribed as having sail cloth panels running parallel to both the leech and the foot of the sail. The miter seam generally bisects the clew angle formed by the leech panel and the foot panel of the sail. It is of course recognized that this bisect angle may be varied by a number of degrees either way but this variation in no way takes such a construction outside of the spirit of the present invention. The sail of the present invention is constructed of panels diagonal to the luff with one mitired center seam generally bicecting the clew angle.

The main body of the scotch-cut sail of the present invention is composed of a sail weight that is generally the proper weight for the area in which the boat is generally sailed. This weight is usually 5 to 6 ounce dacron, although the weight could vary from 3 to 8 ounce dacron and the material may also vary from the use of dacron. This limitation is only guided by the selection of the cloth such as nylon, cotton, kevlor, a registered trademark of Du Pont & Co., Inc. and Mylar also a registered trademark of Du Pont & Co. These and any other sail cloth material are all included within the scope of the present invention.

A luff flattening panel is secured to the luff of the sail of present invention, thereby providing for the flat shape of the sail to be maintained and eliminating unwanted bulging of a roller-furled sail as it is furled. The luff flattening panel is generally curved in shape, ranging generally from the head to the tack of the sail along the luff. The width of the luff flattening panel is generally determined by the length of the luff of the sail. The longer the luff the wider the curved flattening panel. It is recognized, of course, that the description of the dimensions are generally a guide for optimum shape. The actual selection of the dimensions does not take such a sail out of the scope of the present invention.

It should also be noted that the scotch-cut panels in the sail of the present invention reduces stress on the seams of the roller-furling sail thereby increasing longevity of the sail. In general roller-furling sails have horizontal panels and direct pressure is constantly being exerted on the seams as the sail is furled again and again and causes many seams to blow out within the first year of use.

In a preferred embodiment of the present invention a dacron roller-furling genoa sail is constructed in a reverse miter or Scotch-cut. The sail is constructed with the panels diagonal to the luff with one miter center seam bisecting the angle of the clew. The main body of the sail is made of 5 to 6 ounce dacron and the outer panel of the leech and the foot are made of 7 to 8 ounce dacron. A curved luff flattening panel is sewn into the luff of the sail. The genoa is rigged on the jib roller-furling system of a sailing yacht. As the wind increases the sail is furled and the lighter sail material area is reduced, as a result an overall higher percentage of heavier sail cloth area is presented to the wind and at the same time reducing the overall sail area of the sail. The sail is also maintained flat.

DISCUSSION OF MAIN SAIL

The present invention has been described supra with respect to head sails such a jibs. It is part of the present invention to construct a main sail in the same manner as the jibs are constructed and used with main sail roller-furling gear. The main sail is constructed in the Scotch-cut wherein the main body of the sail is made of lighter weight sail cloth dacron, the leech panel and the foot panel is made of a heavier weight sail cloth dacron in the same manner as the jib. A luff flattening panel is also sewn at the luff of the main sail. As with the jib, the size of the luff of main sail will determine the number of varying weight sail cloth panels that are used in the sail. The main sail is rigged on the main sail roller-furling system of a sailing yacht. As the wind increases the main sail is furled and the lighter sail material area is reduced, as a result, an overall higher percentage of heavier sail area is presented to the wind and at the same time reducing the overall sail area of the main sail. The sail is also maintained flat.

All of the foregoing and still further advantages of the present invention will become apparent from a study of the specification taken in connection with the accompanying drawing wherein like characters of reference designate corresponding parts through the several views and wherein.

Figure 1:
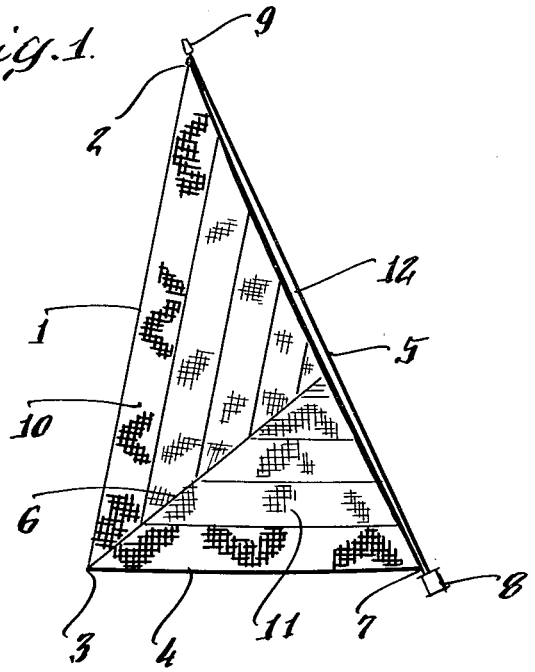
FIG. 1 is a plain view of the roller-furling genoa jib fully entended.

In the drawings, a genoa jib sail is shown in FIG. 1 on roller-furling gear where the numeral 8 indicates a roller-furling drum and 9 is a roller-furling headswivel. In the sail itself 1 is the leech, 4 is the foot, 5 is the luff, 2 is the head, 7 is the tack and 3 is the clew. The construction of this new sail of the present invention which has a Scotch-cut design is shown, wherein the miter seam is indicated at 6, the heavier weight panels are shown at 10, the lighter weight main body of the sail is at 11 and the luff flattening panel is shown at 12. The sail shown in FIG. 1, for example, would have, in its fully unfurled position as shown therein, about 70 percent light weight panel cloth 11 and about 30 percent heavy weight panel cloth 10.

Figure 2:
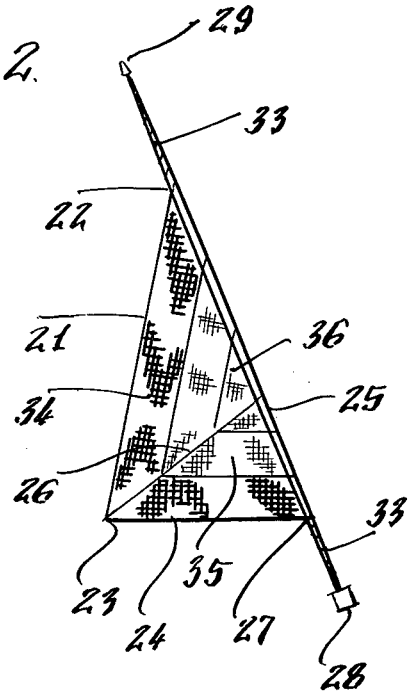
FIG. 2 is a plain view of the roller-furling genoa jib furled to storm jib position.

In the furled position example of the sail as shown in FIG. 2, 28 shows the roller-furling drum and 29 is the roller-furling head swivel. In the furled sail 21 is the leech, 24 is the foot, 25 is the newly formed luff, 22 is the new head, 27 is the newly formed tack and 23 is the clew. The results of the sail construction of the present invention are shown with the miter seam at 26, the heavier weight panels are at 34, the lighter weight panels are at 35 and the fattened sail shape as a result of luff flattening panel 12 of FIG. 1 is indicated at 36. In the furled sail shown in FIG. 2, as an example, it would have in a storm furled position as shown therein, about 60 percent heavy weight panel cloth 34 and 40 percent lighter weight panel cloth 35.

It is evident that as a sailor furls the sail further the heavy weight panel percentage increases and the light weight panel decreases with lesser total sail area exposed to the wind. Conversely, as the sail is unfurled the percentage of light panel increases and the percentage of the heavier panels decreases with the total sail area increases.

Figure 3:
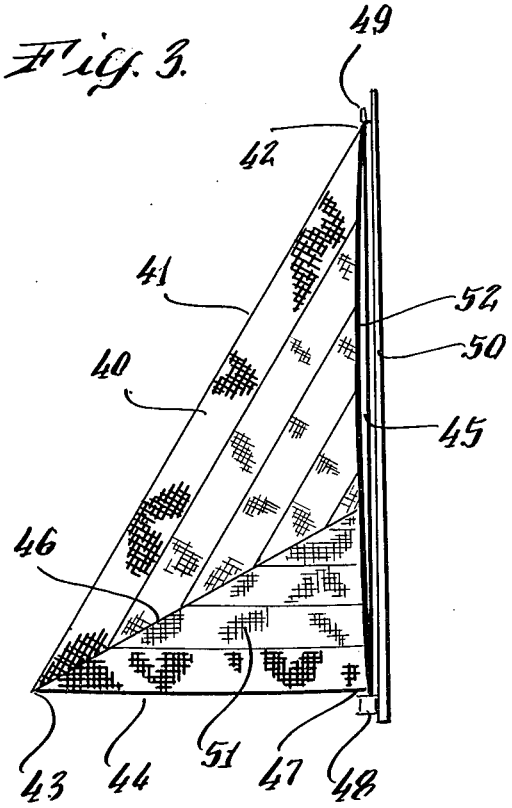
FIG. 3 is a plain view of the roller-furling main sail fully extended.

In FIG. 3 a furling main sail is shown on a mast 50 where the numeral 48 indicates a roller-furling drum and 49 is a roller-furling head swivel. In the sail itself 41 is the leech, 44 is the foot, 45 is the luff, 42 is the head, 47 is the tack and 43 is the clew. The construction of this new sail of the present invention has a Scotch-cut design wherein the miter seam is indicated at 46, the heavier weight panels are shown at 40, the lighter weight main body of the sail is at 51 and the luff flattening panel is shown at 52. The main sail shown in FIG. 3, for example, would have at its fully unfurled position, as shown therein, about 68 percent light weight panel cloth 51 and about 32 percent heavy weight panel cloth 40.

Figure 4:
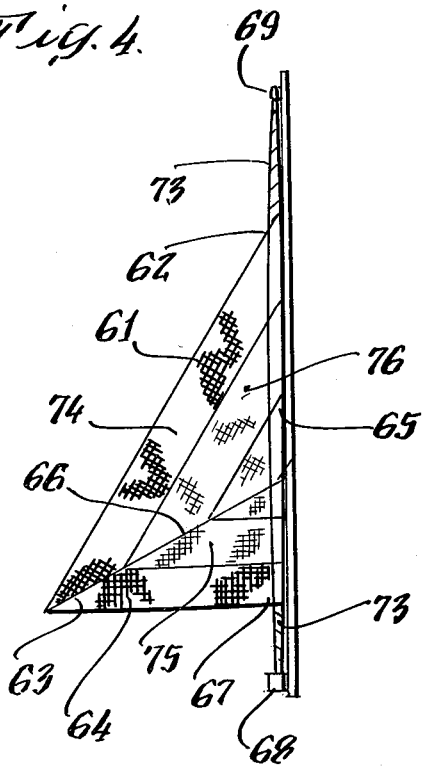
FIG. 4 is a plain view of the roller-furling main sail furled to storm jib position.

In the furled position example of the main sail as shown in FIG. 4, 68 shows the roller-furling drum and 69 is the roller-furling head swivel. In the furled sail 61 is the leech, 64 is the foot, 65 is the newly formed luff, 62 is the new head, 67 is the newly formed tack and 63 is the clew. The results of the sail construction of the present invention are shown with the miter seam at 66, the heavier weight panels are at 74, the lighter weight panels are at 75, and the flattened sail shape as a result of luff flattening panel 52 of FIG. 3 is indicated at 76. In the furled sail shown in FIG. 4, as an example, it would have in the furled position as shown therein, about 60 percent heavy weight panel cloth 74 and 40 percent lighter weight panel cloth 75.

It is evident that as a sailor furls the sail further the heavy weight panel cloth percentage increases and the light weight panel cloth decreases with lesser total sail area exposed to the wind. Conversly, as the sail is unfurled the percentage of light panel cloth increases and the percentage of the heavier panel cloth decreases with the total sail area increases.

Although several embodiments of the invention have been herein illustrated and described it will be evident to those skilled in the art that various modification may be made in the details of construction and method of use without departing from the spirit of the present invention as set forth and limited only by scope of the appended claims.

What is claimed is:

1. A roller furling sail of Scotch-cut design including a plurality of integral panels of varying weight sail cloth wherein an outermost panel that runs along the leach of said sail and the lowermost panel that runs along the foot of the sail are made of the heaviest weight sail cloth; said sail further including at least one inner panel arranged parallel to said outermost panel that runs along the leach and said lowermost panel that runs along the foot of said sail, said inner panels being lighter weight cloth than said outermost and lowermost panels such that the weight of each panel decreases progressively towards the luff of said sail, all panels of said varying weight sail cloth being of substantially the same width.

2. The roller-furling sail of claim 1 wherein said sail further includes at least one intermediate panel and innermost panel arranged parallel to said outermost and lowermost panels; said intermediate panels being lighter than said outermost and lowermost panels and heavier than said innermost panels such that the weight of the sail decreases progressively towards the luff of said sail.

3. The roller-furling sail of claim 2 wherein a luff flattening panel is secured to the luff of said sail.

4. The roller-furling sail of claim 2 wherein said sail is a jib.

5. The roller-furling sail of claim 2 wherein said sail is a mainsail.

6. The roller-furling sail of claim 3 wherein said luff flattenning panel is secured to said sail from the area of the tack to the area of the head along the luff.

* * * * *